United States Patent [19]

Goede

[11] 3,946,555

[45] Mar. 30, 1976

[54] PROCESS FOR SIMULATING TURBOJET ENGINE PLUMES

[75] Inventor: Philip J. Goede, Lorton, Va.

[73] Assignee: Atlantic Research Corporation, Alexandria, Va.

[22] Filed: Aug. 22, 1973

[21] Appl. No.: 390,996

[52] U.S. Cl. ..... 60/207; 60/219; 60/254

[51] Int. Cl.[2] ..... C06D 5/00

[58] Field of Search ..... 60/207, 261, 204, 253, 60/254, 273; 244/3.16; 149/43; 102/49.3

[56] References Cited

UNITED STATES PATENTS

| | | | |
|---|---|---|---|
| 2,984,973 | 5/1961 | Stegelman | 60/251 |
| 3,017,748 | 1/1962 | Burnside | 60/251 |
| 3,150,848 | 9/1964 | Lager | 244/3.16 |
| 3,486,339 | 12/1969 | Owens et al. | 60/261 |
| 3,807,169 | 4/1974 | Bradford | 60/261 |

*Primary Examiner*—Samuel Feinberg
*Attorney, Agent, or Firm*—Martha L. Ross

[57] ABSTRACT

A process for simulating the infrared radiation in wave length and intensity and the spatially extended characteristics of the plumes of turbojet engines comprising burning fuel-rich solid gas generator compositions, comprising an organic binder, an oxidizer, and dispersed inorganic particles, of a character such that venting of the combustion products directly into the atmosphere or venting them into the inadequate plume of a separate gas generator to provide a combined plume, produces a plume having the size and radiating characteristics of the turbojet plume being simulated.

132 Claims, No Drawings

PROCESS FOR SIMULATING TURBOJET ENGINE PLUMES

BACKGROUND OF THE INVENTION

It is frequently desirable, for such purposes as target practice, decoys, missile system development, and scientific data, to provide small, low-cost, gas-generating devices which can simulate effectively the plumes of turbojet engines in terms of such characteristics as size and radiant emission, particularly in the infrared wave lengths. It is well known that turbojet engines are primarily liquid-fueled, are employed as the propulsion means for endoatmosphere aircraft, and produce infrared radiant plumes of different size and intensity depending on the particular engine and aircraft.

For the purposes aforedescribed, the simulating device must be relatively small, low cost, and preferably readily expendable. Plume-generating drones have hitherto been employed, but it has been found that their plumes have inadequate radiation characteristics and are frequently too small to be effective simulators of turbojet plumes. Small, solid-propellant rockets which have been developed for such purposes as missiles or meteorological and other upper atmosphere scientific data gathering devices, cannot be employed for the present purpose since they are designed for maximum thrust power or specific impulse and therefore do not produce plumes of the kind desired. Exhaust velocity of the solid particles is too high to give the desired infrared signatures. For example, loading such rockets with fuel-rich propellants essentially burdens them with inert components which reduce specific impulse unless the rocket is equipped with an upstream after-burner device where oxidation is completed, as, for example, with the use of ram air, prior to venting of the combustion products of the rocket into atmosphere. Additionally, exhaust velocity of any solid particles produced is too high to provide the desired infrared signatures.

The term "fuel rich" as employed herein means a gas-generating composition which contains an insufficient number of oxygen atoms available to convert both carbon to carbon monoxide and the inorganic particulates to the stable inorganic oxide. In the event that the inorganic component is non-oxidizable, the number of available oxygen atoms present are insufficient to oxidize the carbon to CO. In making the stoichiometric calculations required to ensure fuel-rich formulations, no provision is made for the oxidation of hydrogen atoms which may be present.

It has been found that particulate solids within a size range of about 0.01 to 100 microns produce much higher radiant intensities than equal masses of either gases or particulate smaller or larger solids. Within the given size range, the radiation characteristics of the particles may be tailored to a wide range of requirements primarily by varying the size and material of the particles.

Although some of the fuel-rich gas-generating compositions employed in the process of the invention have been generically described in the prior art for such purposes as air-augmented high-performance rockets, or as gas-generating propellants, none of the art to applicant's knowledge discloses a process for simulating the plume, in size and radiant intensity, of a turbojet engine or the specific conditions required in the formulation of the gas-generating compositions employed in the process to produce a plume having the required radiation and size characteristics either per se or in combination with a plume which is inadequate in these respects.

SUMMARY OF THE INVENTION

Broadly, the invention comprises a process for simulating the infrared radiation and spatially extended characteristics of the plume produced by a turbojet engine, which comprises burning in a combustion chamber provided with a restricted nozzle, a fuel-rich, solid, gas-generating composition comprising an organic fuel binder, an oxidizer, and dispersed inorganic particulate solids, which may be oxidizable or non-oxidizable materials or mixtures thereof. The oxidizable particles, in either oxidized or unoxidized state, and the non-oxidizable particles, when ejected through the restricted nozzle as components of the combustion products of the burning composition, are particulate solids capable of radiating continum infrared radiation within the wave length range of about 1 to 14 $\mu$. The oxidizer is present in the composition in an amount at least sufficient to support combustion of the composition, thereby producing hot combustion gases by oxidation of the organic fuel binder and heatng the particulate solids, up to an amount sufficient addtionally to oxidize at least some of the inorganic oxidizable particulate solids when such oxidation is desired.

The combustion products are vented out of the restricted nozzle directly into the atmosphere or into the plume of a separate gas-generating device venting into the atmosphere, which is inadequate in infrared radiation intensity in the desired wave lengths or such radiation intensity and size to simulate the plume of a turbojet engine. The plume formed by the direct or combined augmented venting is characterized by a length of about 1 to 100 feet, preferably about 4 to 30 feet, in the atmosphere and contains particulate solids which have a particle size of about 0.01 to 100 $\mu$, preferably about 0.1 to 10 $\mu$, radiate continuum infrared radiation within a wave length range of about 1 to 14 $\mu$, preferably about 3 to 5 $\mu$, and provide a radiation intensity of about 10 to 50,000 watts, preferably about 50 to 10,000 watts per steradian in any given 2 $\mu$ wide wave length band.

DETAILED DESCRIPTION

The organic fuel binder can be any fuel binder which burns or decomposes to produce hot gases and can, for example, be any of the polymeric binders conventionally employed in the gas-generator or propellant art, such as polybutadiene, polyesters, polyurethanes, cellulose derivatives such as its nitrated, acylated, alkylated, or esterified derivatives, polyvinyl chloride, polyethers, polysulfides, polyamides, polyalkanes, and their cross-linked and other derivative modifications.

Many of the solid polymeric binders preferably include high-boiling, organic, liquid plasticizers to improve physical properties and processing of the composition. Any of the numerous organic plasticizers known in the art can be employed. Illustrative examples of suitable organic plasticizers include inert plasticizers, such as sebacates, e.g. dibutyl and dioctyl sebacate; phthalates, e.g. dibutyl and dioctyl phthalate; adipates, e.g. dioctyl adipate; glycol esters of higher fatty acids; hydrocarbon oils; and the like; and active plasticizers such as nitroglycerine, butanetriol trinitrate, diethylene glycol dinitrate, trimethylethane trinitrate, and the like.

The use of an active polymer and/or plasticizer, namely materials which contain molecularly combined oxidizer elements, e.g. oxygen or fluorine, available for self-sustaining combustion, may be advantageous since it reduces the amount of solid, dispersed oxidizing agent otherwise required and increases the loading capability of the infrared radiating component of the composition.

The organic binder (including plasticizer) must be present in an amount at least sufficient to provide an adequate amount of hot gases as an ejection vehicle for the solid radiating particles and to contribute to the provision of an expandable plume of the desired size proportions. It should preferably also be sufficient to provide for ready manufacturing processing of the high particulate solid loading of the composition. In general, the organic binder should be present in an amount of about 7 to 50 percent by weight of the composition.

The oxidizer can be any conventionally employed oxidizer in the gas-generator or propellant art and can be inorganic or organic. Examples of such oxidizers include but are not limited to the ammonium and alkali metal, e.g. Na, K, Li, Cs, chlorates, perchlorates and nitrates, cyclotetramethylene tetranitramine, pentaerythritol tetranitrate, cyclotrimelkylene trinitramine, and the like. The perchlorates and nitrates are preferred. The oxidizer should be present at least in an amount sufficient to support combustion of the composition, thereby producing hot combustion gases by oxidation of the organic fuel binder, up to an amount sufficient additionally to oxidize at least some of the inorganic oxidizable particulate when present and such oxidation desired. The oxidizer is generally employed in the range of about 8 to 60 weight percent.

The inorganic particulate solids dispersed in the composition for ejection as infrared radiating solids may be oxidizable or non-oxidizable. They are selected from materials which are capable of emitting, after ejection in their oxidized, unoxidized, or otherwise inert state, continuum infrared radiation in the wave length range of about 1 to 14 $\mu$, preferably about 3 to 5 $\mu$. Such materials can be readily determined from available handbooks and other available publications. The wave lengths and intensity of the continuum radiation are also determined by the size of the particles and the available heat energy.

The term "oxidizable" as employed in the specification and claims refers to materials which (1) are oxidizable in the combustion chamber to produce solid ejectable oxides, or (2) are oxidizable after ejection as part of the hot plume where, in the course of mixing with the oxygen in the atmosphere, they oxidize into either particulate solid oxides or into gases.

In the former case, which includes, for example, metals such as Zr, Al, Mg, and B, oxidation of at least a portion of the inorganic particles within the combustion chamber contributes to the elevated temperatures within the range required to impart adequate simulation infrared radiation in the plume. The solid oxide particles should be produced within the required size range. This can be accomplished by such factors as proper selection of the oxidizable material.

In the latter case, the ejected, unoxidized, oxidizable particles provide the desired radiation in the plume, then undergo oxidation as they mix with atmospheric oxygen at progressive distances from the ejecting nozzle to produce additional thermal energy release, thereby expanding the size of the plume to a desired size and assuring the desired infrared radiation. The controlled oxidation over the desired varying distance from the nozzle can be accomplished by employing the oxidizable material in a range of size so that the larger particles travel a longer distance, by tailoring the geometry of the ejecting nozzle, or by other means such as attachment of a flame-holder downstream of the nozzle. Since the oxidizable particles are ejected in their non-oxidized state, they may include materials which oxidize either to solid or gaseous oxides. If the oxides formed are solid particles which also emit continuum infrared in the desired range, they also perform to simulate the turbojet plume. In cases where the oxide is a gas, as in the oxidation of carbon, heat release and resulting expansion are the primary objectives. It is also desirable that sufficient carbon be ejected to provide the desired infrared continuum if it is the sole radiating particulate solid. It should be noted, however, that the gases produced do augment to some extent the infrared emission.

The term "non-oxidazible" as employed in the specification and claims, means a material which is non-oxidizable per se, such as a fully oxidized solid compound, e.g. MgO, $Al_2O_3$, $ZrO_2$, $B_2O_3$, and the like, or a compound or element which does not oxidize under the conditions of the reactions either in the combustion chamber or in the plume. This generally is the case because the temperatures generated and/or oxidizer concentration are inadequate for oxidation. Examples of such materials are BC, BN and C. As in the case of the oxidizable materials, the non-oxidizable material must be selected so that within the desired size and temperature ranges it will provide continuum infrared radiation within the desired wave length band. Such information can readily be determined by those skilled in the art by reference to publications and routine experimentation.

Where non-oxidizable solid particles are employed, it may be desirable to include a minor percentage, e.g. about 1 to 30 percent by weight, preferably about 5 to 20 percent, of an inorganic material which is readily oxidizable in the combustion chamber to provide adequate heat energy for transfer to the non-oxidizable infrared radiating particulate solids. Examples include, but are not limited to, Mg, Al, Zr, and C. Preferably, but not essentially, such oxidizable additives also produce radiating solid oxides.

It should also be noted that some oxidizable inorganic materials such as B and C may not readily oxidize in the combustion chamber and it may be desirable to add a readily oxidizable inorganic solid particulate, such as Mg, Al, Zr, in the amounts stated above to provide adequate heat release for transfer to the ejected B, which will then oxidize with atmospheric oxygen in the plume.

Other conventional additives may be incorporated in the usual small amounts. These include, for example, burning rate additives, stabilizers for the polymeric fuel binder, and the like.

Although the compositions are relatively low-performance in terms of specific impulse, this is not an important criterion since primary application is the formation of simulating turbojet plumes.

The temperatures generated by the compositions, either alone or in combination with the plume of a device being augmented, should generally be in the range of about 1000° to 3500°K, preferably about 1500° to 2500°K.

The compositions can be tailored to simulate the plumes of different turbojet aircraft, which, of course, vary both in infra-red radiation intensity and plume size, by varying the gas- and particle-generating compositions in such terms as component species, concentrations, and particle sizes, or varying the flow rate, employing the routine experimentation available to those skilled in the art.

The compositions can also be tailored for such specific applications as direct or augmented production of a simulating plume.

In the cases where the compositions are employed to provide complete simulation of a turbojet plume, as, for example, in the case of a tow target or decoy, the composition must be tailored directly to produce a plume of adequate size having adequate infrared wave length and intensity as aforementioned. Since the gas generator is desirably small and low-cost, the desired plume is preferably produced by fuel-rich compositions loaded with oxidizable particulate solids which are ejected unburned and which burn in the plume upon mixing with atmospheric oxygen, thereby expanding the size of the plume and extending the heat release within the plume to produce the desired infrared radiation throughout its length. Examples of such inorganic components include but are not limited to carbon, boron, aluminum, magnesium, zirconium, and the like.

In the case where the turbojet plume simulating device is employed to augment the plume of an existing device, such as a drone, which is inadequate in infrared radiating power and possibly, in addition, plume size, the infrared-producing device of the invention can be tailored in composition to utilize the heat generated by the augmented device for heat transfer to the infra-red radiating particles produced by the augmenting device. For example, the augmenting composition can be tailored primarily to eject non-oxidizable or inert components, such as fully oxidized materials, e.g. metallic oxides, which are loaded into the composition as such or are oxidized in the combustion chamber, or materials which normally do not oxidize under conditions in the combustion chamber or in the plume, such as BC. Of course, depending on the characteristics of the augmented plume, the augmenting device can also be tailored to eject oxidizable particles which burn in the plume as aforedescribed, or a mixture of inert and oxidizing particles. The augmented plume size, if necessary, can also be increased to the required dimensions by injection of oxidizable particles and/or by addition of hot gases generated by the augmenting device.

EXAMPLE 1

A gas-generating grain was cast from the following composition:

| | WT. % |
|---|---|
| Boron (1 $\mu$) | 46.00 |
| Ammonium perchlorate | 25.00 |
| Mg/Al alloy | 8.00 |
| Carboxy-terminated polybutadiene | 8.05 |
| Burning rate catalyst | 6.00 |
| Hydrocarbon oil plasticizer | 3.00 |
| Coconut oil derivative wetting agent | 3.00 |
| Epoxide curing agents | 0.90 |
| chromium octoate (5.5%) | 0.05 |

The grain was burned in a combustion chamber equipped with a restricted nozzle to produce a high temperature plume 40 feet long. The Mg/Al alloy burned in the combustion chamber to produce Mg and Al oxides which were ejected in the form of particles of about 1 $\mu$ size. The boron was ejected in non-oxidized state and burned to a minor extent in the plume.

A second firing of the same grain composition was made with a flameholder attached downstream of the nozzle. Substantially all of the ejected boron was oxidized to particulate boron oxide in the plume.

Firing of the above composition at different mass flow rates ($m$), obtained by varying nozzle throat diameter, with and without the attached flameholder, produced the following radiation characteristics in the plume:

| m | W/str.* No flameholder | W/str.* flameholder |
|---|---|---|
| 45 gms/sec | 700 | 1000 |
| 55 gms/sec | 1600 | 2750 |
| 70 gms/sec | 3000 | 5400 |

*Watts per steradian in the 3 to 5 micron wave length band taken at 90° from the center line.

EXAMPLE 2

A gas-generating grain was cast of the following composition:

| | |
|---|---|
| Carboxy-terminated polybutadiene | 11.694 |
| Hydrocarbon oil plasticizer | 3.00 |
| Coconut oil wetting agent | 3.00 |
| Chromium octoate | 0.05 |
| Burning rate catalyst | 6.00 |
| Carbon (0.2$\mu$) | 21.00 |
| Boron (1 $\mu$) | 21.00 |
| Ammonium perchlorate | 25.00 |
| Mg/Al alloy | 8.00 |
| Epoxide curing agents | 1.256 |

The grain was burned as in Example 1 to produce a 40-foot plume. The Mg/Al alloy burned in the combustion chamber to produce Mg Al oxides which were ejected in the form of particles of about 1 $\mu$ size. The boron and carbon were ejected in the plume in unoxidized state. Substantially no oxidation of the boron and carbon occurred in the plume.

A second firing of the same composition was made with a flameholder attached downstream of the nozzle. All of the boron was progressively oxidized in the plume with little or no combustion of the carbon.

Firings of the above composition at different flow rates with an attached flameholder produced the following radiation characteristics in the plume:

| m | W/str.* |
|---|---|
| 45 gms/sec | 1700 |
| 55 gms/sec | 5000 |
| 70 gms/sec | 10000 |

*Watts per steradian in the 3 to 5 micron wave length band taken at 90° from the center line.

EXAMPLE 3

A gas-generating grain was cast from the following composition:

| | Wt. % |
|---|---|
| Carboxy-terminated polyester | 7.01 |
| Resorcinol | 0.25 |
| Trimethylolethane trinitrate | 20.00 |
| Chromium octoate (5.5%) | 0.40 |
| Carbon (0.2 $\mu$) | 35.00 |
| $KClO_4$ | 20.00 |
| Zirconium | 15.00 |
| Epoxide curing agents | 2.34 |

The grain was burned in a combustion chamber equipped with a restricted nozzle. The plume generated was injected into the plume generated by a small J-69 turbojet engine employed as the propulsion means for a small drone.

The Zr powder was substantially completely burned in the combustion chamber to produce $ZrO_2$ particles which were ejected in an average size of 1.1 micron. The carbon was ejected unburned. The length of the augmented plume was more than 20 feet.

The following radiation characteristics were measured for the J-69 turbojet engine and the augmented plume:

| | W/str.* |
|---|---|
| J-69 | 15 |
| Combined plume[1] | 91 |

*Watts per steradian in the 3 to 5 micron wave length band taken at 57° from the center line.
[1]Mass flow rate 40 gms/sec.

Although this invention has been described with reference to illustrative embodiments thereof, it will be apparent to those skilled in the art that the principles of the invention can be embodied in other forms but within the scope of the claims.

I claim:

1. A process for simulating the plume produced by a turbojet engine comprising producing a plume comprising high-velocity combustion gases admixed with small infrared-radiating solid particles, by 1. burning in a combustion chamber provided with a restricted nozzle, a fuel-rich solid gas-generating composition, comprising
   a. solid organic fuel binder,
   b. solid oxidizer, and
   c. dispersed, inorganic, particulate solids selected from the group consisting of oxidizable material, non-oxidizable material, and mixtures thereof, said oxidizer being present at least in an amount sufficient to support combustion of said composition, thereby producing hot combustion gases by oxidation of said organic fuel binder and heating said dispersed particulate solids, up to an amount sufficient additionally to oxidize at least some of said inorganic oxidizable particulate solids when such oxidation is desired, the maximum amount of oxidizer in said composition being stoichiometrically insufficient a. to oxidize all of the carbon present in the composition to CO when the inorganic particulate solid component is non-oxidizable;
   b. to oxidize all of both the carbon and an oxidizable inorganic particulate solid to CO and the stable inorganic oxide of said oxidizable particulate when an inorganic particulate solid component is oxidizable; and
   c. to oxidize any substantial amount of hydrogen to $H_2O$;

2. ejecting the combustion products out of said restricted nozzle directly into the atmosphere or into the plume of a separate gas-generating device which ejects into atmosphere, the plume of which is inadequate in infrared radiation or such radiation and size to simulate the plume of a turbojet engine; said oxidizable material in its oxidized or unoxidized state and said non-oxidizable material, when ejected as components of the combustion products of said gas-generating composition through said restricted nozzle, being particulate solids capable of radiating continuum infrared radiation within the wavelength range of about 1 to 14 microns; the gaseous plume formed by the direct ejection or by the combined augmented ejection being characterized by a length of about 1 to 100 feet in the atmosphere and containing dispersed particulate solids which have a particle size of about 0.01 to 100 microns, radiate continuum infrared radiation within a wave length range of about 1 to 14 microns, and provide a radiation intensity of about 10 to 50,000 watts per steradian in any given 2 micron wide wave length band in said infrared wave lengths; the particular characteristics of said plume being determined by and similar to the infrared radiation and spatially-extended characteristics of the particular turbojet engine being simulated.

2. The process of claim 1 wherein the continuum infrared radiation is within the range of about 3 to 5 microns.

3. The process of claim 1 wherein the ejected particulate solids have a particle size of about 0.1 to 10 microns.

4. The process of claim 2 wherein the ejected particulate solids have a particular size of about 0.1 to 10 microns.

5. The process of claim 1 wherein the length of the plume is about 4 to 30 feet.

6. The process of claim 2 wherein the length of the plume is about 4 to 30 feet.

7. The process of claim 3 wherein the length of the plume is about 4 to 30 feet.

8. The process of claim 4 wherein the length of the plume is about 4 to 30 feet.

9. The process of claim 1 wherein the radiation intensity is about 50 to 10,000 watts per steradian in any given 2 micron wide wave length band.

10. The process of claim 2 wherein the radiation intensity is about 50 to 10,000 watts per steradian in any given 2 micron wide wave length band.

11. The process of claim 3 wherein the radiation intensity is about 50 to 10,000 watts per steradian in any given 2 micron wide wave length band.

12. The process of claim 4 wherein the radiation intensity is about 50 to 10,000 watts per steradian in any given 2 micron wide wave length band.

13. The process of claim 5 wherein the radiation intensity is about 50 to 10,000 watts per steradian in any given 2 micron wide wave length band.

14. The process of claim 6 wherein the radiation intensity is about 50 to 10,000 watts per steradian in any given 2 micron wide wave length band.

15. The process of claim 7 wherein the radiation intensity is about 50 to 10,000 watts per steradian in any given 2 micron wide wave length band.

16. The process of claim 8 wherein the radiation intensity is about 50 to 10,,000 watts per steradian in any given 2 micron wide wave length band.

17. The process of claim 1 wherein at least a portion of the particulate solids are oxidizable and are at least partially oxidized within said chamber.

18. The process of claim 2 wherein at least a portion of the particulate solids are oxidizable and are at least partially oxidized within said chamber.

19. The process of claim 3 wherein at least a portion of the particulate solids are oxidizable and are at least partially oxidized within said chamber.

20. The process of claim 4 wherein at least a portion of the particulate solids are oxidizable and are at least partially oxidized within said chamber.

21. The process of claim 5 wherein at least a portion of the particulate solids are oxidizable and are at least partially oxidized within said chamber.

22. The process of claim 6 wherein at least a portion of the particulate solids are oxidizable and are at least partially oxidized within said chamber.

23. The process of claim 7 wherein at least a portion of the particulate solids are oxidizable and are at least partially oxidized within said chamber.

24. The process of claim 8 wherein at least a portion of the particulate solids are oxidizable and are at least partially oxidized within said chamber.

25. The process of claim 9 wherein at least a portion of the particulate solids are oxidizable and are at least partially oxidized within said chamber.

26. The process of claim 16 wherein at least a portion of the particulate solids are oxidizable and are at least partially oxidized within said chamber.

27. The process of claim 17 wherein at least a portion of the oxidizable particulate solids are ejected in said oxidizable state.

28. The process of claim 18 wherein at least a portion of the oxidizable particulate solids are ejected in said oxidizable state.

29. The process of claim 19 wherein at least a portion of the oxidizable particulate solids are ejected in said oxidizable state.

30. The process of claim 20 wherein at least a portion of the oxidizable particulate solids are ejected in said oxidizable state.

31. The process of claim 21 wherein at least a portion of the oxidizable particulate solids are ejected in said oxidizable state.

32. The process of claim 22 wherein at least a portion of the oxidizable particulate solids are ejected in said oxidizable state.

33. The process of claim 23 wherein at least a portion of the oxidizable particulate solids are ejected in said oxidizable state.

34. The process of claim 24 wherein at least a portion of the oxidizable particulate solids are ejected in said oxidizable state.

35. The process of claim 25 wherein at least a portion of the oxidizable particulate solids are ejected in said oxidizable state.

36. The process of claim 26 wherein at least a portion of the oxidizable particulate solids are ejected in said oxidizable state.

37. The process of claim 17 wherein at least a portion of the ejected oxidizable particulate solids are oxidized by atmospheric oxygen in said plume.

38. The process of claim 18 wherein at least a portion of the ejected oxidizable particulate solids are oxidized by atmospheric oxygen in said plume.

39. The process of claim 19 wherein at least a portion of the ejected oxidizable particulate solids are oxidized by atmospheric oxygen in said plume.

40. The process of claim 20 wherein at least a portion of the ejected oxidizable particulate solids are oxidized by atmospheric oxygen in said plume.

41. The process of claim 21 wherein at least a portion of the ejected oxidizable particulate solids are oxidized by atmospheric oxygen in said plume.

42. The process of claim 22 wherein at least a portion of the ejected oxidizable particulate solids are oxidized by atmospheric oxygen in said plume.

43. The process of claim 23 wherein at least a portion of the ejected oxidizable particulate solids are oxidized by atmospheric oxygen in said plume.

44. The process of claim 24 wherein at least a portion of the ejected oxidizable particulate solids are oxidized by atmospheric oxygen in said plume.

45. The process of claim 25 wherein at least a portion of the ejected oxidizable particulate solids are oxidized by atmospheric oxygen in said plume.

46. The process of claim 26 wherein at least a portion of the ejected oxidizable particulate solids are oxidized by atmospheric oxygen im said plume.

47. The process of claim 17 wherein at least a portion of the particulate solids are non-oxidizable and are ejected in said non-oxidizable state.

48. The process of claim 18 wherein at least a portion of the particulate solids are non-oxidizable and are ejected in said non-oxidizable state.

49. The process of claim 19 wherein at least a portion of the particulate solids are non-oxidizable and are ejected in said non-oxidizable state.

50. The process of claim 20 wherein at least a portion of the particulate solids are non-oxidizable and are ejected in said non-oxidizable state.

51. The process of claim 21 wherein at least a portion of the particulate solids are non-oxidizable and are ejected in said non-oxidizable state.

52. The process of claim 22 wherein at least a portion of the particulate solids are non-oxidizable and are ejected in said non-oxidizable state.

53. The process of claim 23 wherein at least a portion of the particulate solids are non-oxidizable and are ejected in said non-oxidizable state.

54. The process of claim 24 wherein at least a portion of the particulate solids are non-oxidizable and are ejected in said non-oxidizable state.

55. The process of claim 25 wherein at least a portion of the particulate solids are non-oxidizable and are ejected in said non-oxidizable state.

56. The process of claim 26 wherein at least a portion of the particulate solids are non-oxidizable and are ejected in said non-oxidizable state.

57. The process of claim 1 wherein the combustion products ejected from said combustion chamber are ejected into the plume of a separate plume-generating gas-generator which is deficient in infrared radiation.

58. The process of claim 2 wherein the combustion products ejected from said combustion chamber are ejected into the plume of a separate plume-generating gas-generator which is deficient in infrared radiation.

59. The process of claim 3 wherein the combustion products ejected from said combustion chamber are ejected into the plume of a separate plume-generating gas-generator which is deficient in infrared radiation.

60. The process of claim 4 wherein the combustion products ejected from said combustion chamber are ejected into the plume of a separate plume-generating gas-generator which is deficient in infrared radiation.

61. The process of claim 5 wherein the combustion products ejected from said combustion chamber are ejected into the plume of a separate plume-generating gas-generator which is deficient in infrared radiation.

62. The process of claim 6 wherein the combustion products ejected from said combustion chamber are ejected into the plume of a separate plume-generating gas-generator which is deficient in infrared radiation.

63. The process of claim 7 wherein the combustion products ejected from said combustion chamber are ejected into the plume of a separate plume-generating gas-generator which is deficient in infrared radiation.

64. The process of claim 8 wherein the combustion products ejected from said combustion chamber are ejected into the plume of a separate plume-generating gas-generator which is deficient in infrared radiation.

65. The process of claim 9 wherein the combustion products ejected from said combustion chamber are ejected into the plume of a separate plume-generating gas-generator which is deficient in infrared radiation.

66. The process of claim 10 wherein the combustion products ejected from said combustion chamber are ejected into the plume of a separate plume-generating gas-generator which is deficient in infrared radiation.

67. The process of claim 11 wherein the combustion products ejected from said combustion chamber are ejected into the plume of a separate plume-generating gas-generator which is deficient in infrared radiation.

68. The process of claim 12 wherein the combustion products ejected from said combustion chamber are ejected into the plume of a separate plume-generating gas-generator which is deficient in infrared radiation.

69. The process of claim 13 wherein the combustion products ejected from said combustion chamber are ejected into the plume of a separate plume-generating gas-generator which is deficient in infrared radiation.

70. The process of claim 14 wherein the combustion products ejected from said combustion chamber are ejected into the plume of a separate plume-generating gas-generator which is deficient in infrared radiation.

71. The process of claim 15 wherein the combustion products ejected from said combustion chamber are ejected into the plume of a separate plume-generating gas-generator which is deficient in infrared radiation.

72. The process of claim 16 wherein the combustion products ejected from said combustion chamber are ejected into the plume of a separate plume-generating gas-generator which is deficient in infrared radiation.

73. The process of claim 17 wherein the combustion products ejected from said combustion chamber are ejected into the plume of a separate plume-generating gas-generator which is deficient in infrared radiation.

74. The process of claim 18 wherein the combustion products ejected from said combustion chamber are ejected into the plume of a separate plume-generating gas-generator which is deficient in infrared radiation.

75. The process of claim 19 wherein the combustion products ejected from said combustion chamber are ejected into the plume of a separate plume-generating gas-generator which is deficient in infrared radiation.

76. The process of claim 20 wherein the combustion products ejected from said combustion chamber are ejected into the plume of a separate plume-generating gas-generator which is deficient in infrared radiation.

77. The process of claim 21 wherein the combustion products ejected from said combustion chamber are ejected into the plume of a separate plume-generating gas-generator which is deficient in infrared radiation.

78. The process of claim 22 wherein the combustion products ejected from said combustion chamber are ejected into the plume of a separate plume-generating gas-generator which is deficient in infrared radiation.

79. The process of claim 23 wherein the combustion products ejected from said combustion chamber are ejected into the plume of a separate plume-generating gas-generator which is deficient in infrared radiation.

80. The process of claim 24 wherein the combustion products ejected from said combustion chamber are ejected into the plume of a separate plume-generating gas-generator which is deficient in infrared radiation.

81. The process of claim 25 wherein the combustion products ejected from said combustion chamber are ejected into the plume of a separate plume-generating gas-generator which is deficient in infrared radiation.

82. The process of claim 26 wherein the combustion products ejected from said combustion chamber are ejected into the plume of a separate plume-generating gas-generator which is deficient in infrared radiation.

83. The process of claim 27 wherein the combustion products ejected from said combustion chamber are ejected into the plume of a separate plume-generating gas-generator which is deficient in infrared radiation.

84. The process of claim 28 wherein the combustion products ejected from said combustion chamber are ejected into the plume of a separate plume-generating gas-generator which is deficient in infrared radiation.

85. The process of claim 29 wherein the combustion products ejected from said combustion chamber are ejected into the plume of a separate plume-generating gas-generator which is deficient in infrared radiation.

86. The process of claim 30 wherein the combustion products ejected from said combustion chamber are ejected into the plume of a separate plume-generating gas-generator which is deficient in infrared radiation.

87. The process of claim 31 wherein the combustion products ejected from said combustion chamber are ejected into the plume of a separate plume-generating gas-generator which is deficient in infrared radiation.

88. The process of claim 32 wherein the combustion products ejected from said combustion chamber are ejected into the plume of a separate plume-generating gas-generator which is deficient in infrared radiation.

89. The process of claim 33 wherein the combustion products ejected from said combustion chamber are ejected into the plume of a separate plume-generating gas-generator which is deficient in infrared radiation.

90. The process of claim 34 wherein the combustion products ejected from said combustion chamber are ejected into the plume of a separate plume-generating gas-generator which is deficient in infrared radiation.

91. The process of claim 35 wherein the combustion products ejected from said combustion chamber are ejected into the plume of a separate plume-generating gas-generator which is deficient in infrared radiation.

92. The process of claim 36 wherein the combustion products ejected from said combustion chamber are ejected into the plume of a separate plume-generating gas-generator which is deficient in infrared radiation.

93. The process of claim 37 wherein the combustion products ejected from said combustion chamber are ejected into the plume of a separate plume-generating gas-generator which is deficient in infrared radiation.

94. The process of claim 38 wherein the combustion products ejected from said combustion chamber are ejected into the plume of a separate plume-generating gas-generator which is deficient in infrared radiation.

95. The process of claim 39 wherein the combustion products ejected from said combustion chamber are ejected into the plume of a separate plume-generating gas-generator which is deficient in infrared radiation.

96. The process of claim 40 wherein the combustion products ejected from said combustion chamber are ejected into the plume of a separate plume-generating gas-generator which is deficient in infrared radiation.

97. The process of claim 41 wherein the combustion products ejected from said combustion chamber are ejected into the plume of a separate plume-generating gas-generator which is deficient in infrared radiation.

98. The process of claim 42 wherein the the combustion products ejected from said combustion chamber are ejected into the plume of a separate plume-generating gas-generator which is deficient in infrared radiation.

99. The process of claim 43 wherein the combustion products ejected from said combustion chamber are ejected into the plume of a separate plume-generating gas-generator which is deficient in infrared radiation.

100. The process of claim 44 wherein the combustion products ejected from said combustion chamber are ejected into the plume of a separate plume-generating gas-generator which is deficient in infrared radiation.

101. The process of claim 45 wherein the combustion products ejected from said combustion chamber are ejected into the plume of a separate plume-generating gas-generator which is deficient in infrared radiation.

102. The process of claim 46 wherein the combustion products ejected from said combustion chamber are ejected into the plume of a separate plume-generating gas-generator which is deficient in infrared radiation.

103. The process of claim 47 wherein the combustion products ejected from said combustion chamber are ejected into the plume of a separate plume-generating gas-generator which is deficient in infrared radiation.

104. The process of claim 48 wherein the combustion products ejected from said combustion chamber are ejected into the plume of a separate plume-generating gas-generator which is deficient in infrared radiation.

105. The process of claim 49 wherein the combustion products ejected from said combustion chamber are ejected into the plume of a separate plume-generating gas-generator which is deficient in infrared radiation.

106. The process of claim 50 wherein the combustion products ejected from said combustion chamber are ejected into the plume of a separate plume-generating gas-generator which is deficient in infrared radiation.

107. The process of claim 51 wherein the combustion products ejected from said combustion chamber are ejected into the plume of a separate plume-generating gas-generator which is deficient in infrared radiation.

108. The process of claim 52 wherein the combustion products ejected from said combustion chamber are ejected into the plume of a separate plume-generating gas-generator which is deficient in infrared radiation.

109. The process of claim 53 wherein the combustion products ejected from said combustion chamber are ejected into the plume of a separate plume-generating gas-generator which is deficient in infrared radiation.

110. The process of claim 54 wherein the combustion products ejected from said combustion chamber are ejected into the plume of a separate plume-generating gas-generator which is deficient in infrared radiation.

111. The process of claim 55 wherein the combustion products ejected from said combustion chamber are ejected into the plume of a separate plume-generating gas-generator which is deficient in infrared radiation.

112. The process of claim 56 wherein the combustion products ejected from said combustion chamber are ejected into the plume of a separate plume-generating gas-generator which is deficient in infrared radiation.

113. The process of claim 1 wherein at least a portion of the particulate solids are B, C, Al, Mg, Zr, BC, BN, or mixtures thereof.

114. The process of claim 2 wherein at least a portion of the particulate solids are B, C, Al, Mg, Zr, BC, BN, or mixtures thereof.

115. The process of claim 3 wherein at least a portion of the particulate solids are B, C, Al, Mg, Zr, BC, BN, or mixtures thereof.

116. The process of claim 4 wherein at least a portion of the particulate solids are B, C, Al, Mg, Zr, BC, BN, or mixtures thereof.

117. The process of claim 5 wherein at least a portion of the particulate solids are B, C, Al, Mg, Zr, BC, BN, or mixtures thereof.

118. The process of claim 6 wherein at least a portion of the particulate solids are B, C, Al, Mg, Zr, BC, BN, or mixtures thereof.

119. The process of claim 7 wherein at least a portion of the particulate solids are B, C, Al, Mg, Zr, BC, BN, or mixtures thereof.

120. The process of claim 8 wherein at least a portion of the particulate solids are B, C, Al, Mg, Zr, BC, BN, or mixtures thereof.

121. The process of claim 9 wherein at least a portion of the particulate solids are B, C, Al, Mg, Zr, BC, BN, or mixtures thereof.

122. The process of claim 16 wherein at least a portion of the particulate solids are B, C, Al, Mg, Zr, BC, BN, or mixtures thereof.

123. The process of claim 113 wherein at least a portion of the particulate solids are B, C, or mixtures thereof.

124. The process of claim 114 wherein at least a portion of the particulate solids are B, C, or mixtures thereof.

125. The process of claim 115 wherein at least a portion of the particulate solids are B, C, or mixtures thereof.

126. The process of claim 116 wherein at least a portion of the particulate solids are B, C, or mixtures thereof.

127. The process of claim 117 wherein at least a portion of the particulate solids are B, C, or mixtures thereof.

128. The process of claim 118 wherein at least a portion of the particulate solids are B, C or mixtures thereof.

129. The process of claim 119 wherein at least a portion of the particulate solids are B, C, or mixtures thereof.

130. The process of claim 120 wherein at least a portion of the particulate solids are B, C, or mixtures thereof.

131. The process of claim 121 wherein at least a portion of the particulate solids are B, C, or mixtures thereof.

132. The process of claim 122 wherein at least a portion of the particulate solids are B, C, or mixtures thereof.

* * * * *